US007892366B2

(12) United States Patent
Lindh

(10) Patent No.: US 7,892,366 B2
(45) **Date of Patent: *Feb. 22, 2011**

(54) DUPLEX STAINLESS STEEL ALLOY AND USE THEREOF

(75) Inventor: Anders Lindh, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 10/547,704

(22) PCT Filed: Feb. 19, 2004

(86) PCT No.: PCT/SE2004/000224

§ 371 (c)(1),
(2), (4) Date: Feb. 22, 2006

(87) PCT Pub. No.: WO2004/079028

PCT Pub. Date: Sep. 16, 2004

(65) Prior Publication Data

US 2006/0196582 A1 Sep. 7, 2006

(30) Foreign Application Priority Data

Mar. 2, 2003 (SE) ..... 0300573

(51) Int. Cl.
*C22C 38/52* (2006.01)
*C22C 38/44* (2006.01)

(52) U.S. Cl. ..... 148/325; 148/327; 420/38; 420/39; 420/52; 420/59; 420/65

(58) Field of Classification Search ..... 148/325–326, 148/327; 420/43, 52, 67, 38, 39, 59, 65
See application file for complete search history.

(56) References Cited

U.S. PATENT DOCUMENTS 3,539,013 A * 11/1970 Smith ..... 210/242.4

(Continued)

FOREIGN PATENT DOCUMENTS

EP 0220141 4/1987

(Continued)

OTHER PUBLICATIONS

International Search Report for PCT/SE2004/000223, completed May 27, 2004.

*Primary Examiner*—Deborah Yee
(74) *Attorney, Agent, or Firm*—Drinker Biddle & Reath LLP

(57) ABSTRACT

The present invention relates to a stainless steel alloy, more specifically a duplex stainless steel alloy with a ferritic-austenitic matrix and high corrosion resistance in combination with good structure stability, specifically a duplex stainless steel with a ferrite content of 40-65% and a well balanced analysis and with a combination of high corrosion resistance and good mechanical properties, such as high ultimate strength and good ductility which is especially suitable for use in applications in oil and gas explorations such as wire, especially as reinforced wire in wireline applications. These purposes are achieved according to the invention by a duplex stainless steel alloy that contains (in wt %): C 0-0.03%; Si up to max 0.5%; Mn 0-3.0%; Cr 24.0-30.0%; Ni 4.9-10.0%; Mo 3.0-5.0%; N 0.28-0.5%; S up to max. 0.010%; Co 0-3.5%; W 0-3.0%; Cu 0-2%; Ru 0-0.3%; Al 0-0.03; Ca 0-0.010%; the balance being Fe and unavoidable impurities.

18 Claims, 5 Drawing Sheets

U.S. PATENT DOCUMENTS

| | | | | | |
|---|---|---|---|---|---|
| 5,238,508 | A | * | 8/1993 | Yoshitake et al. | 148/325 |
| 5,298,093 | A | * | 3/1994 | Okamoto | 148/325 |
| 5,352,406 | A | * | 10/1994 | Barteri et al. | 420/49 |
| 5,395,583 | A | * | 3/1995 | Potgieter et al. | 420/67 |
| 5,582,656 | A | * | 12/1996 | Kangas et al. | 148/325 |
| 5,906,791 | A | * | 5/1999 | Angeliu | 420/40 |
| 6,312,532 | B1 | * | 11/2001 | Kangas | 148/325 |
| 6,451,133 | B1 | * | 9/2002 | Frodigh et al. | 148/325 |
| 2001/0031217 | A1 | | 10/2001 | Bergstrom et al. | |
| 2003/0133823 | A1 | * | 7/2003 | Sundstrom et al. | 420/52 |
| 2005/0158201 | A1 | * | 7/2005 | Park et al. | 420/40 |

FOREIGN PATENT DOCUMENTS

| | | | | |
|---|---|---|---|---|
| EP | 0455625 | A1 | | 11/1991 |
| EP | 0534864 | A1 | | 3/1993 |
| EP | 0683241 | A2 | | 11/1995 |
| EP | 0897018 | A1 | | 2/1999 |
| EP | 000897018 | A1 | * | 2/1999 |
| EP | 0683241 | | * | 8/2000 |
| JP | 6116684 | | | 4/1994 |
| JP | 8260101 | | | 10/1996 |
| JP | 9209087 | | | 8/1997 |
| SE | 0102931 | A | | 3/2003 |
| WO | WO 00/28101 | | * | 5/2000 |

* cited by examiner

DUPLEX STAINLESS STEEL ALLOY AND USE THEREOF

This application claims priority from International Application No. PCT/SE2004/000224, filed on Feb. 19, 2004; and Swedish Application No. 0300573-3, filed on Mar. 2, 2003, the subject matter of which is incorporated herein by reference.

The present invention relates to a stainless steel alloy, more specifically a duplex stainless steel alloy with a ferritic-austenitic matrix and with high corrosion resistance towards chloride containing environments in combination with use at high temperatures in combination with good structural stability and hot workability, with a combination of high corrosion resistance and good mechanical properties, such as high ultimate strength, good ductility and strength, that is especially suitable for use in wire applications in oil and gas exploration such as wire, rope and lines for slicklines, wire-lines and well-logging cables.

BACKGROUND AND PRIOR ART

In connection with more limited access to natural resources such as oil and gas when these resources become smaller and being of less quality efforts are being made to fund New resources or such resources that until now have not been exploited due to excessively high costs for extraction and subsequent processes such as transport and further fabrication of the raw material, maintenance of the resource and measuring operations.

Exploration of oil and gas from the sea bottom in deep se is an established technology. Transport of equipment and goods to and from the source and transmission of signal and energy is managed from the water surface. In very deep waters there might be transport distance that amounts up to 10,000 meters for such applications. Wire, rope or cables of stainless steel is used to a greater extent in applications for off-shore exploration of oil and gas.

So-called wirelines are today usually made in such manner that they contain several isolated electrical leads or cables such as fiber-optical cables which in their entirety are covered by one or several layers of helically extending steel wires. The selection of the steel grade is determined primarily by the demands for strength, ultimate strength and ductility in combination with suitable corrosion properties especially under those conditions valid for oil and gas explorations.

The usage is limited largely due to resistance to fatigue due to repeated use in oil and gas industry, especially when used as slick-line, wire-line or wellbore logging cable and in applications of repeated coiling and transportation over a so-called pulley-wheel. The possibility of usage of the material is limited in thus sector of the ultimate strength of the wire material being used. The degree of cold deformation is usually optimized with regard to the ductility. Specially the austenitic materials do however not satisfy the practical demands.

The latest years, when environments for usage of corrosion resistant metallic materials have become more demanding has caused increased requirements upon the corrosion properties of the material as well as their mechanical properties. Duplex steel alloys, established as alternative for the hitherto used steel alloys such as highly alloyed austenitic steels, nickel base alloys or other highly alloyed steels are not excluded from this development. There are high demands for corrosion resistance when the string, rope. or the line is exposed to high mechanical properties and the very corrosive environment when the surrounding isolation of a plastic material such as polyurethane is damaged and made unusable very quickly during repeated coiling. More recent developments are therefore aimed at using the reinforced wire as the outermost layer.

There is furthermore a desire of significantly higher strength than achieved with today's technology for a certain degree of cold deformation.

The disadvantage with the duplex alloys used today is the existence of hard and brittle intermetallic precipitations in the steel, such as sigma phase, especially after heat treatment during the manufacture or during subsequent working. This leads to harder material with worse workability and finally worse corrosion resistance and possibly crack propagations.

In order to furthermore improve the corrosion resistance of duplex stainless steels it is demanded an increase of the PRE number in both the ferrite as well as in the austenite phase without simultaneously impairing the structure stability or workability of the material. If the analysis in the two phases is not equal with regard to the active alloy constituents one phase will become susceptible for nodular or crevice corrosion. Hence, the more corrosion sensitive phase will govern the resistance of the alloy whereas the structure stability is governed by the most alloyed phase.

SUMMARY

It is an object of the invention to provide a duplex stainless steel alloy with a combination of high corrosion resistance and good mechanical properties such as high impact strength, good ductility and strength.

It is a further object of the invention to provide a duplex stainless steel alloy that is specifically suitable for use in wire applications in oil and gas explorations such as wires, ropes and lines for so-called slicklines, wirelines and well-logging cables. It is therefore a purpose of the invention to provide a duplex stainless steel alloy with ferritic-austenitic matrix and high corrosion resistance in chloride containing environments in combination with use under high temperatures in combination with good structure stability and hot workability.

The material according to the invention, with its high amounts of alloy elements, appears with good workability and will therefore be very suitable for being used for the manufacture of wires.

The alloy of the present invention can advantageously be used as an isolated wire in slickline applications and as so-called braided wire where several wires of same or different diameters are clogged together.

These objects are fulfilled with an alloy according to the invention which contains (in weight-%)

SHORT DESCRIPTION OF THE DRAWINGS

DETAILED DESCRIPTION

Figure 1:
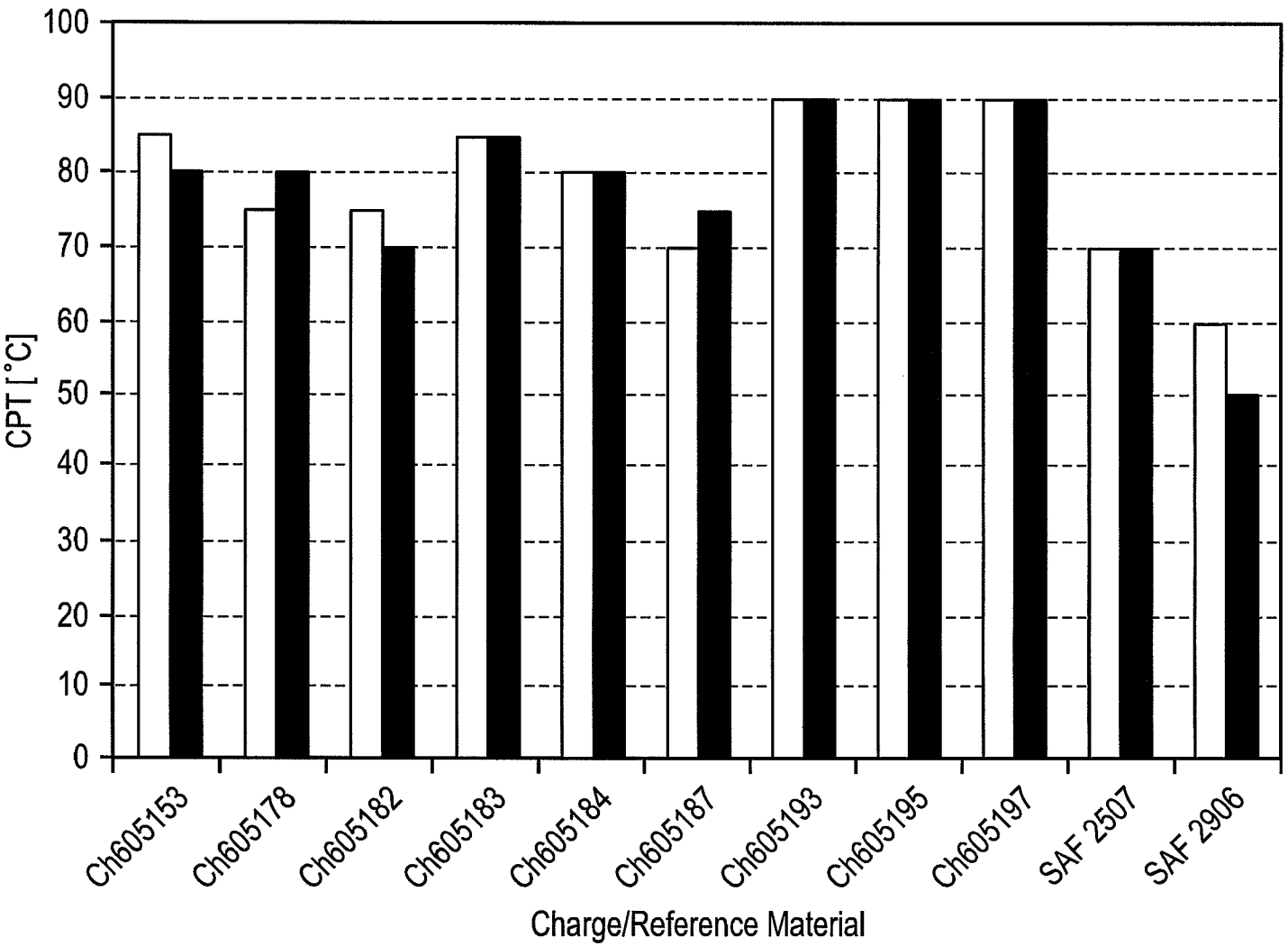
FIG. 1 shows CPT values from tests of heats in the modified ASTM G48C test in "green death"-solution compared with the duplex steels SAF 2507, SAF 2906.

A systematic development work has surprisingly shown that an alloy with an amount of alloying elements according to the invention satisfies these demands.

The importance of the alloy elements for the invention

Carbon has a limited solubility in both austenite and ferrite. The limited solubility causes a risk for precipitation of chromium carbides and the content thereof should therefore not exceed 0.03 wt %, preferably not exceed 0.02 wt %.

Silicon is used as deoxidation agent in the steel manufacture and increases flowability during manufacture and welding. However, too high amounts of Si will cause precipitation of undesirable intermetallic phase and the content thereof should therefore be limited to max 0.5 wt %, preferably max 0.3 wt %.

Manganese is added to increase N-solubility in the material. It has been found, however, that Mn has only a limited impact on the N-solubility in the actual type of alloy. There are instead other elements that gives higher impact on the solubility. Further, Mn in combination with high sulphur contents can give rise to manganese sulphides which act as initiation points for point corrosion. The Mn-content should therefore be limited to a value in the range 0-3.0 wt %, preferably 0.5-1.2 wt %.

Chromium is a very active element for increasing the resistance to most types of corrosion. A high Cr-content further leads to a very good solubility of nitrogen in the material. It is therefore desirable to keep the Cr-content as high as possible to improve the corrosion resistance. To achieve very good values of corrosion resistance the Cr-content should amount to at least 24.0 wt %, preferably 26.5-29.0 wt %. High Cr-amounts do however increase the tendency for intermetallic precipitations and the Cr-content should therefore be limited upwards to max 30.0 wt %.

Nickel is used as an austenite stabilizer element and should be added in suitable amounts such that desired ferrite content is achieved. In order to achieve the desired relation between the austenitic and the ferritic phases with 40-65 volume % ferrite there is required an added amount in the range 4.9-10.0 wt % nickel, preferably 4.9-9.0 wt %, and specifically 6.0-9.0 wt %.

Molybdenum is an active element which improves corrosion resistance in chloride environments and preferably in reducing acids. If the Mo-content is too high combined with too high Cr-content this could increase the amount of intermetallic precipitations. The Mo-content should therefore be in the range of 3.0-5.0 wt %, preferably 3.6-4.9 wt %, more specifically 4.4-4.9 wt %.

Nitrogen is a very active element that increases corrosion resistance, structure stability and the strength of the material. A high amount of nitrogen furthermore increases the recreation of austenite after welding which gives a good weld joint with good properties. To achieve a good effect of nitrogen its content should be at least 0.28 wt %. If the N-amount is high this could give rise to increased porosity due to exceeded solubility of N in the melt. For these reasons the N-content should be limited to max 0.5 wt %, and preferably there should be added an amount of 0.35-0.45 wt % N.

If the amounts of Cr and N are too high this will result in precipitation of $Cr_2N$ which should be avoided since this causes impairment of the properties of the material, especially during heat treatment, for instance at welding.

Boron is added to increase hot workability of the material. If too high boron content is present weldability and corrosion resistance could be negatively affected. The boron content should therefore exceed 0 and be present in amounts up to 0.0030 wt %.

Sulphur has a negative impact on corrosion resistance by formation of sulphides which are easily soluble. This causes impaired hot workability and the sulphur content should therefore be limited to max 0.010 wt %.

Cobalt is added primarily to improve the structure stability and the corrosion resistance. Co is an austenite stabilizer. In order to achieve its effect at least 0.5 wt %, preferably at least 1.0 wt % should be added to the alloy. Since cobalt is a relatively expensive element the added cobalt amount should be limited to max 3.5 wt %.

Tungsten increases the resistance against point and crevice corrosion. Adding too much tungsten combined with high Cr- and Mo-amounts will increase the risk for intermetallic precipitations. The tungsten content in the present invention should lie in the range 0-3.0 wt %, preferably between 0-1.8 wt %.

Copper is added to improve the general corrosion resistance in acid environments such as sulphuric acid. Cu also affects the structure stability. High amounts of Cu leads, however, to an excessive firm solubility. The Cu-content should therefore be limited to max 2 wt %, preferably between 0.1 and 1.5 wt %.

Ruthenium is added to the alloy in order to increase the corrosion resistance. However, since ruthenium is a very expensive element its content should be limited to max 0.3 wt %, preferably larger than=and up to 0.1 wt %.

Aluminum and calcium should be used as desoxidation elements during the steel production. The amount of Al should be limited to max 0.03 wt % to limit the nitride formation. Ca has a positive effect on hot ductility but the Ca-content ought to be limited to 0.01 wt % to avoid undesired amount of slag.

The ferrite content is important to achieve good mechanical properties and corrosion properties and good weldability. From corrosion standpoint and weldability standpoint it is desirable to have a ferrite content of 40-65% to achieve good properties. High ferrite content furthermore results in a risk of unpaired low temperature impact toughness and resistance towards hydrogen embrittlement. The ferrite content is therefore 40-65 vol %, preferably 42-65 vol %, and most preferably 45-55 vol %.

DESCRIPTION OF PREFERRED EMBODIMENTS

In the examples given below there is disclosed the analysis for a number of test charges which will illustrate the impact that various alloy elements will have upon the properties. Charge 605182 represents a reference analysis and is thus not included in the range within the scope of the invention. Also, all other charges shall not be considered as limiting the invention but rather to define examples of charges that illustrate the invention pursuant to the patent claims. The PRE-values as given are always referring to values calculated according to the PREW-formula even if not expressly defined.

Example 1

The test charges according to this example are made by laboratory casting of an ingot of 170 kg that was hot forged to a round bar. This was then hot extruded to bar shape (round bar and plate-shaped bar) where the test material was sampled out from the round bar. The plate-shaped bar was subject of heat treatment before cold rolling after which additional test material was sampled out. From a material-technical standpoint, this process is considered as representative for manufacture in a larger scale. Table 1 shows the analysis of the test charges.

TABLE 1

| Charge | Mn | Cr | Ni | Mo | W | Co | V | La | Ti | N |
|---|---|---|---|---|---|---|---|---|---|---|
| 605193 | 1.03 | 27.90 | 8.80 | 4.00 | 0.01 | 0.02 | 0.04 | 0.01 | 0.01 | 0.36 |
| 605195 | 0.97 | 27.90 | 9.80 | 4.00 | 0.01 | 0.97 | 0.55 | 0.01 | 0.35 | 0.48 |
| 605197 | 1.07 | 28.40 | 8.00 | 4.00 | 1.00 | 1.01 | 0.04 | 0.01 | 0.01 | 0.44 |
| 605178 | 0.91 | 27.94 | 7.26 | 4.01 | 0.99 | 0.10 | 0.07 | 0.01 | 0.03 | 0.44 |
| 605183 | 1.02 | 28.71 | 6.49 | 4.03 | 0.01 | 1.00 | 0.04 | 0.01 | 0.04 | 0.28 |
| 605184 | 0.99 | 28.09 | 7.83 | 4.01 | 0.01 | 0.03 | 0.54 | 0.01 | 0.01 | 0.44 |
| 605187 | 2.94 | 27.74 | 4.93 | 3.98 | 0.01 | 0.98 | 0.06 | 0.01 | 0.01 | 0.44 |
| 605153 | 2.78 | 27.85 | 6.93 | 4.03 | 1.01 | 0.02 | 0.06 | 0.02 | 0.01 | 0.34 |
| 605182 | 0.17 | 23.48 | 7.88 | 5.75 | 0.01 | 0.05 | 0.04 | 0.01 | 0.10 | 0.26 |

In order to investigate the structure stability specimen were taken out from every charge and heat treated at 900-1150 degrees C. with 50 degrees step and quenched in air and water respectively. At the lowest temperatures intermetallic phases were obtained. The lowest temperature where the amount of intermetallic phase was negligible was determined by means of studies in a light optical microscope. New specimen from respective charge were then heat treated at said temperature for five minutes after which the specimen was subject of cooling with a constant cooling speed of −140 degrees C. down to room temperature.

The point corrosion properties of all charges have been tested by ranking in the so-called "green-death"-solution which consists of 1% $FeCl_3$, 1% $CuCl_2$, 11% $H_2S0_4$, 1.2% HCl. This testing procedure corresponds to point corrosion testing according to ASTM G48C but is carried out in the more aggressive "green-death"-solution. Further, some charges have been tested according to ASTNIG48C (2 tests per charge). Also electrochemical testing in 3% NaCl (6 tests per charge) have been carried out. The results in the form of critical point corrosion temperature (CPT) from all tests appear from Table 2, like the PREW-value (Cr+3.3 (Mo+0.5W)+16N) for the total alloy analysis and for austenite and ferrite. The indexing alfa relates to ferrite and gamma relates to austenite.

TABLE 2

| Charge | PRE α | PRE γ | PRE γ/PRE α | PRE | CPT ° C. Modified ASTM G48C Green Death | CPT ° C. ASTM G48C 6% $FeCl_3$ | CPT ° C. 3% NaCl (600 mv SCE |
|---|---|---|---|---|---|---|---|
| 605193 | 51.3 | 49.0 | 0.9552 | 46.9 | 93/90 | | 64 |
| 605195 | 51.5 | 48.9 | 0.9495 | 48.7 | 93/90 | | 95 |
| 605197 | 53.3 | 53.7 | 1.0075 | 50.3 | 93/90 | >95 | >95 |
| 605178 | 50.7 | 52.5 | 1.0355 | 49.8 | 75/80 | | 94 |
| 605183 | 48.9 | 48.9 | 1.0000 | 46.5 | 85/85 | 90 | 93 |
| 605184 | 48.9 | 51.7 | 1.0573 | 48.3 | 83/80 | | 72 |
| 605187 | 48.0 | 54.4 | 1.1333 | 48.0 | 73/75 | | 77 |
| 605153 | 49.6 | 51.9 | 1.0464 | 48.3 | 83/85 | 85 | 90 |
| 605182 | 54.4 | 46.2 | 0.8493 | 46.6 | 75/70 | 85 | 62 |
| SAF2507 | 39.4 | 42.4 | 1.0761 | 41.1 | 73/70 | 80 | 95 |
| SAF2906 | 39.6 | 46.4 | 1.1717 | 41.0 | 60/50 | 75 | 75 |

The strength at room temperature (RT), 100° C. and 200° C. and the impact strength at room temperature (RT) has been determined for all charges and is shown as average value out of three tests.

Tensile test pieces (DR-5C50) were made from extruded bars, diameter 20 mm, which were heat treated at room temperature according to Table 2 for 20 minutes followed by cooling either in air or water (605195, 605197, 605184). The results of this investigation is presented in Table 3. The results from the tensile strength testing investigation show that the contents of chromium, nitrogen and tungsten strongly affect the tensile strength in the material. All charges except 605153 satisfy the requirement of a 25% increase when subjected to tensile testing in room temperature (RT).

TABLE 3

| Charge | Temperatur | $R_{p0.2}$ (MPa) | $R_{p0.1}$ (MPa) | $R_m$ (MPa) | A5 (%) | Z (%) |
|---|---|---|---|---|---|---|
| 605193 | RT | 652 | 791 | 916 | 29.7 | 38 |
| | 100° C. | 513 | 646 | 818 | 30.4 | 36 |
| | 200° C. | 511 | 583 | 756 | 29.8 | 36 |
| 605195 | RT | 671 | 773 | 910 | 38.0 | 66 |
| | 100° C. | 563 | 637 | 825 | 39.3 | 68 |
| | 200° C. | 504 | 563 | 769 | 38.1 | 64 |
| 605197 | RT | 701 | 799 | 939 | 38.4 | 66 |
| | 100° C. | 564 | 652 | 844 | 40.7 | 69 |
| | 200° C. | 502 | 577 | 802 | 35.0 | 65 |
| 605178 | RT | 712 | 828 | 925 | 27.0 | 37 |
| | 100° C. | 596 | 677 | 829 | 31.9 | 45 |
| | 200° C. | 535 | 608 | 763 | 27.1 | 36 |
| 605183 | RT | 677 | 775 | 882 | 32.4 | 67 |
| | 100° C. | 560 | 642 | 788 | 33.0 | 59 |
| | 200° C. | 499 | 578 | 737 | 29.9 | 52 |
| 605184 | RT | 702 | 793 | 915 | 32.5 | 60 |
| | 100° C. | 569 | 657 | 821 | 34.5 | 61 |

TABLE 3-continued

| Charge | Temperatur | $R_{p0.2}$ (MPa) | $R_{p0.1}$ (MPa) | $R_m$ (MPa) | A5 (%) | Z (%) |
|---|---|---|---|---|---|---|
| | 200° C. | 526 | 581 | 774 | 31.6 | 56 |
| 605187 | RT | 679 | 777 | 893 | 35.7 | 61 |
| | 100° C. | 513 | 628 | 799 | 38.9 | 64 |
| | 200° C. | 505 | 558 | 743 | 35.8 | 58 |

TABLE 3-continued

| Charge | Temperatur | $R_{p0.2}$ (MPa) | $R_{p0.1}$ (MPa) | $R_m$ (MPa) | A5 (%) | Z (%) |
|---|---|---|---|---|---|---|
| 605153 | RT | 715 | 845 | 917 | 20.7 | 24 |
| | 100° C. | 572 | 692 | 817 | 29.3 | 27 |
| | 200° C. | 532 | 611 | 749 | 23.7 | 31 |
| 605182 | RT | 627 | 754 | 903 | 28.4 | 43 |
| | 100° C. | 493 | 621 | 802 | 31.8 | 42 |

Example 2

In the following example the analysis is given for yet another number of test charges made for the purpose to find the optimal analysis. These charges are modified outgoing from the properties of those charges with good structure stability and high corrosion resistance from the results shown in Example 1. All the charges in table 4 are included by the analysis according to the present invention where charge 1-8 are part of a statistic test plan whereas charge e to n are further test alloys within the scope of the present invention.

A number of test charges were made by casting 270 kg ingots that were hot forged into cylindrical rods. These were subject of extrusion to bars out of which test pieces were taken. These were then subject of heating before fold rolling of plate shaped bar after which further test piece were taken out. Table 4 shows the analysis for these test charges.

TABLE 4

| | Charge | Mn | Cr | Ni | Mo | W | Co | Cu | Ru | B | N |
|---|---|---|---|---|---|---|---|---|---|---|---|
| 1 | 605258 | 1.1 | 29.0 | 6.5 | 4.23 | | 1.5 | | | 0.0018 | 0.46 |
| 2 | 605249 | 1.0 | 28.8 | 7.0 | 4.23 | | 1.5 | | | 0.0026 | 0.38 |
| 3 | 605259 | 1.1 | 29.0 | 6.8 | 4.23 | | 0.6 | | | 0.0019 | 0.45 |
| 4 | 605260 | 1.1 | 27.5 | 5.9 | 4.22 | | 1.5 | | | 0.0020 | 0.44 |
| 5 | 605250 | 1.1 | 28.8 | 7.6 | 4.24 | | 0.6 | | | 0.0019 | 0.40 |
| 6 | 605251 | 1.0 | 28.1 | 6.5 | 4.24 | | 1.5 | | | 0.0021 | 0.38 |
| 7 | 605261 | 1.0 | 27.8 | 6.1 | 4.22 | | 0.6 | | | 0.0021 | 0.43 |
| 8 | 605252 | 1.1 | 28.4 | 6.9 | 4.23 | | 0.5 | | | 0.0018 | 0.37 |
| e | 605254 | 1.1 | 26.9 | 6.5 | 4.8 | | 1.0 | | | 0.0021 | 0.38 |
| f | 605255 | 1.0 | 28.6 | 6.5 | 4.0 | | 3.0 | | | 0.0020 | 0.31 |
| g | 605262 | 2.7 | 27.6 | 6.9 | 3.9 | 1.0 | 1.0 | | | 0.0019 | 0.36 |
| h | 605263 | 1.0 | 28.7 | 6.6 | 4.0 | 1.0 | 1.0 | | | 0.0020 | 0.40 |
| i | 605253 | 1.0 | 28.8 | 7.0 | 4.16 | | 1.5 | | | 0.0019 | 0.37 |
| j | 605266 | 1.1 | 30.0 | 7.1 | 4.02 | | | | | 0.0018 | 0.38 |
| k | 605269 | 1.0 | 28.5 | 7.0 | 3.97 | 1.0 | 1.0 | | | 0.0020 | 0.45 |
| l | 605268 | 1.1 | 28.2 | 6.6 | 4.0 | 1.0 | 1.0 | 1.0 | | 0.0021 | 0.43 |
| m | 605270 | 1.0 | 28.8 | 7.0 | 4.2 | | 1.5 | | 0.1 | 0.0021 | 0.41 |
| n | 605267 | 1.1 | 29.3 | 6.5 | 4.23 | | | 1.5 | | 0.0019 | 0.38 |

The distribution of the alloy elements in the ferrite and austenite phase was investigated by microsound analysis, the results of which appear from Table 5.

TABLE 5

| Charge | Phase | Cr | Mn | Ni | Mo | W | Co | Cu | N |
|---|---|---|---|---|---|---|---|---|---|
| 605258 | Ferrite | 29.8 | 1.3 | 4.8 | 5.0 | | 1.4 | | 0.11 |
| | Austenit | 28.3 | 1.4 | 7.3 | 3.4 | | 1.5 | | 0.60 |
| 605249 | Ferrit | 29.8 | 1.1 | 5.4 | 5.1 | | 1.3 | | 0.10 |
| | Austenite | 27.3 | 1.2 | 7.9 | 3.3 | | 1.6 | | 0.53 |
| 605259 | Ferrite | 29.7 | 1.3 | 5.3 | 5.3 | | 0.5 | | 0.10 |
| | Austenite | 28.1 | 1.4 | 7.8 | 3.3 | | 0.58 | | 0.59 |
| 605260 | Ferrite | 28.4 | 1.3 | 4.4 | 5.0 | | 1.4 | | 0.08 |
| | Austenite | 26.5 | 1.4 | 6.3 | 3.6 | | 1.5 | | 0.54 |
| 605250 | Ferrite | 30.1 | 1.3 | 5.6 | 5.1 | | 0.46 | | 0.07 |
| | Austenite | 27.3 | 1.4 | 8.8 | 3.4 | | 0.53 | | 0.52 |
| 605251 | Ferrite | 29.6 | 1.2 | 5.0 | 5.2 | | 1.3 | | 0.08 |
| | Austenite | 26.9 | 1.3 | 7.6 | 3.5 | | 1.5 | | 0.53 |

TABLE 5-continued

| Charge | Phase | Cr | Mn | Ni | Mo | W | Co | Cu | N |
|---|---|---|---|---|---|---|---|---|---|
| 605261 | Ferrite | 28.0 | 1.2 | 4.5 | 4.9 | | 0.45 | | 0.07 |
| | Austenite | 26.5 | 1.4 | 6.9 | 3.3 | | 0.56 | | 0.56 |
| 605252 | Ferrite | 29.6 | 1.3 | 5.3 | 5.2 | | 0.42 | | 0.09 |
| | Austenite | 27.1 | 1.4 | 8.2 | 3.3 | | 0.51 | | 0.48 |
| 605254 | Ferrite | 28.1 | 1.3 | 4.9 | 5.8 | | 0.89 | | 0.08 |
| | Austenite | 26.0 | 1.4 | 7.6 | 3.8 | | 1.0 | | 0.48 |
| 605255 | Ferrite | 30.1 | 1.3 | 5.0 | 4.7 | | 2.7 | | 0.08 |
| | Austenite | 27.0 | 1.3 | 7.7 | 3.0 | | 3.3 | | 0.45 |
| 605262 | Ferrite | 28.8 | 3.0 | 5.3 | 4.8 | 1.4 | 0.9 | | 0.08 |
| | Austenite | 26.3 | 3.2 | 8.1 | 3.0 | 0.85 | 1.1 | | 0.46 |
| 605263 | Ferrite | 29.7 | 1.3 | 5.1 | 5.1 | 1.3 | 0.91 | | 0.07 |
| | Austenite | 27.8 | 1.4 | 7.7 | 3.2 | 0.79 | 1.1 | | 0.51 |
| 605253 | Ferrite | 30.2 | 1.3 | 5.4 | 5.0 | | 1.3 | | 0.09 |
| | Austenite | 27.5 | 1.4 | 8.4 | 3.1 | | 1.5 | | 0.48 |
| 605266 | Ferrite | 31.0 | 1.4 | 5.7 | 4.8 | | | | 0.09 |
| | Austenite | 29.0 | 1.5 | 8.4 | 3.1 | | | | 0.52 |
| 605269 | Ferrite | 28.7 | 1.3 | 5.2 | 5.1 | 1.4 | 0.9 | | 0.11 |
| | Austenite | 26.6 | 1.4 | 7.8 | 3.2 | 0.87 | 1.1 | | 0.52 |
| 605268 | Ferrite | 29.1 | 1.3 | 5.0 | 4.7 | 1.3 | 0.91 | 0.84 | 0.12 |
| | Austenite | 26.7 | 1.4 | 7.5 | 3.2 | 0.97 | 1.0 | 1.2 | 0.51 |
| 605270 | Ferrite | 30.2 | 1.2 | 5.3 | 5.0 | | 1.3 | | 0.11 |
| | Austenite | 27.7 | 1.3 | 8.0 | 3.2 | | 1.4 | | 0.47 |
| 605267 | Ferrite | 30.1 | 1.3 | 5.1 | 4.9 | | | 1.3 | 0.08 |
| | Austenite | 27.8 | 1.4 | 7.6 | 3.1 | | | 1.8 | 0.46 |

The point corrosion properties of all the charges have been tested by the "green death" solution (1% $FeCl_3$, 1% $CuCl_2$, 11% $H_2SO_4$, 1.2% HCl) for ranking.

Figure 2:
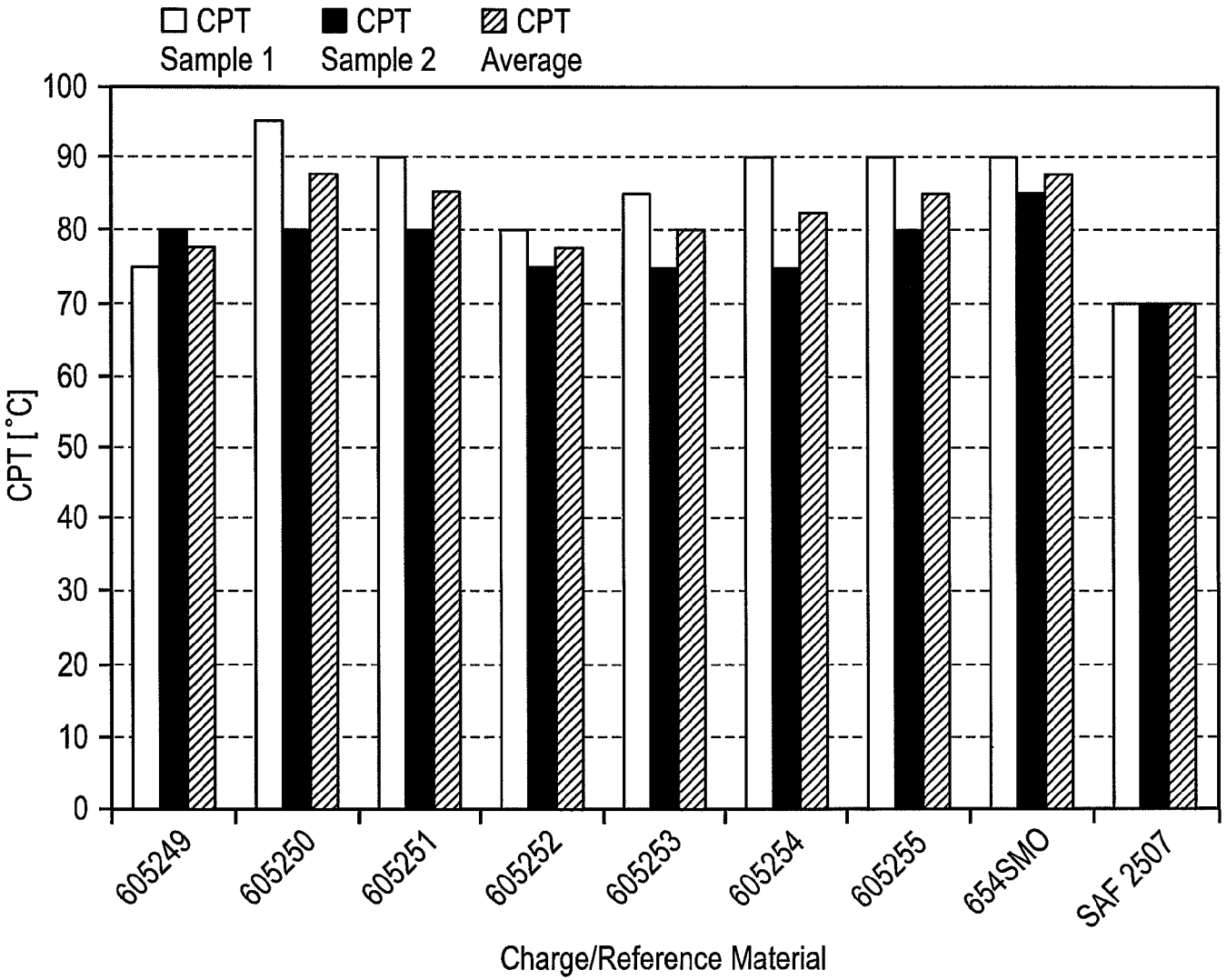
FIG. 2 shows CPT-values obtained by means of the modified ASTM G48C test in "green death"-solution for then test heats compared with duplex steel SAF 2507 and SAF 2906.
Figure 3:
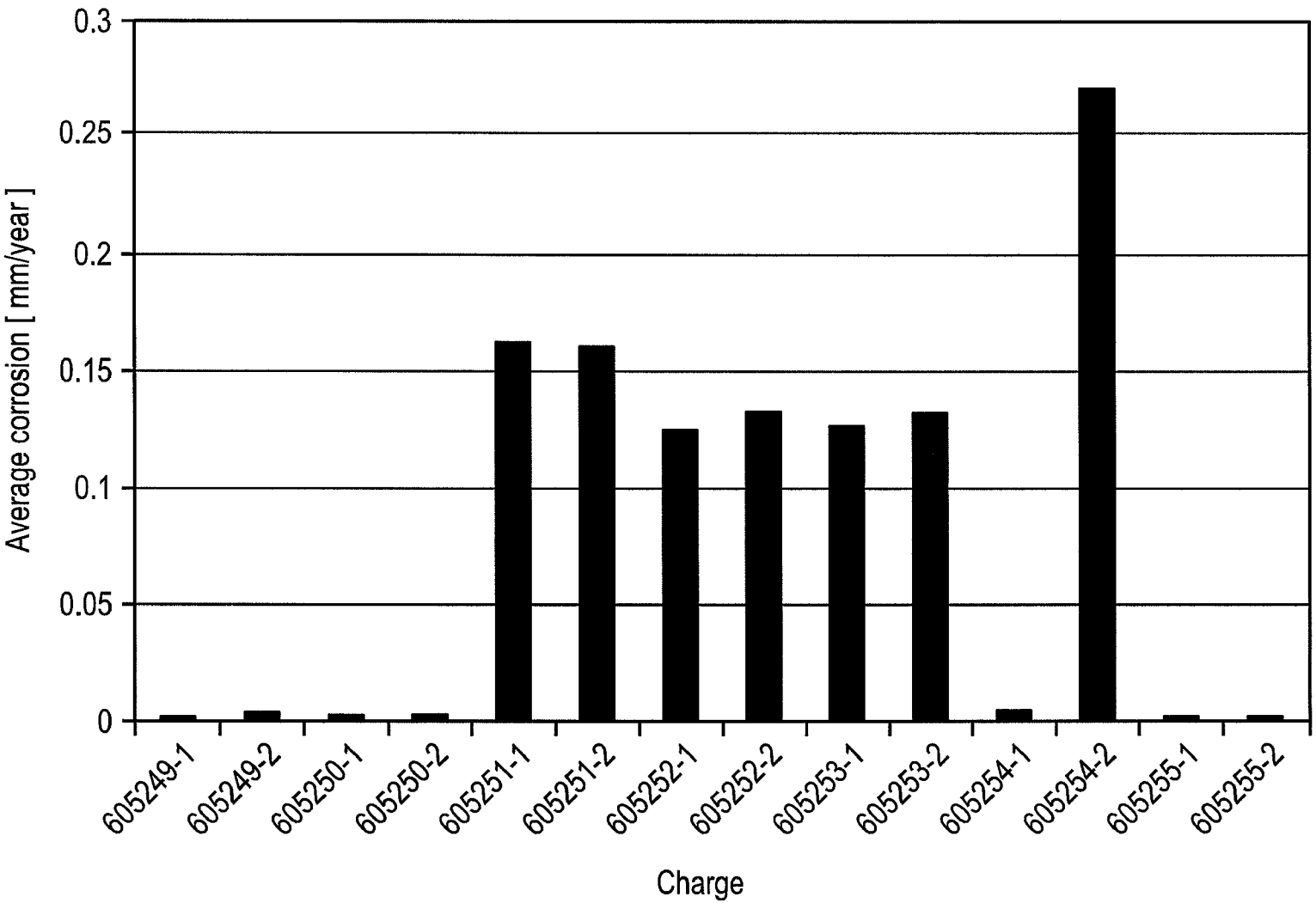
FIG. 3 shows the average value for weight loss in mm/year in 2% HCl at a temperature of 75 degrees C.
Figure 4:
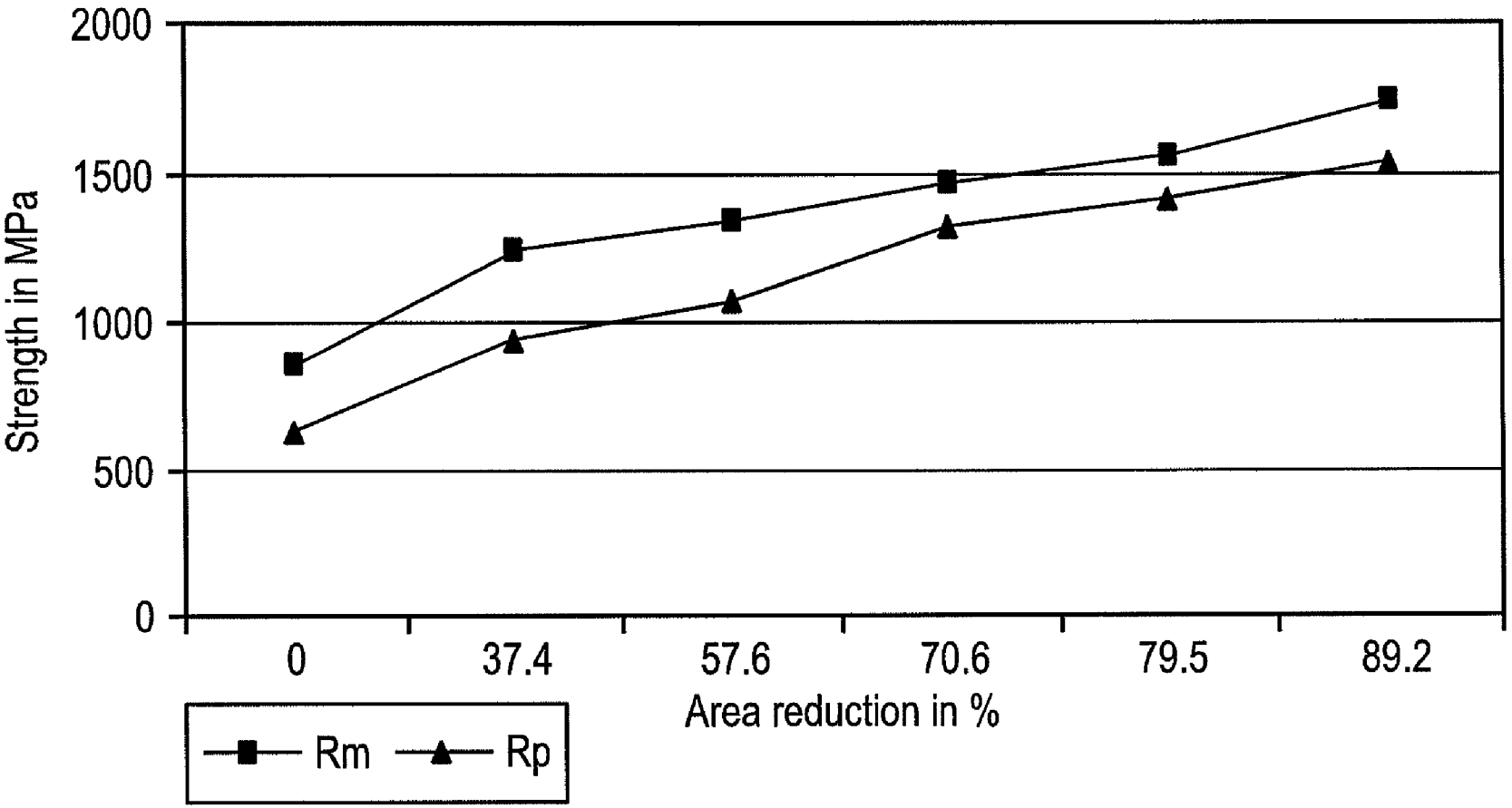
FIG. 4 shows data with regard to impact strength and yield point for the ally type SAF 2205.
Figure 5:
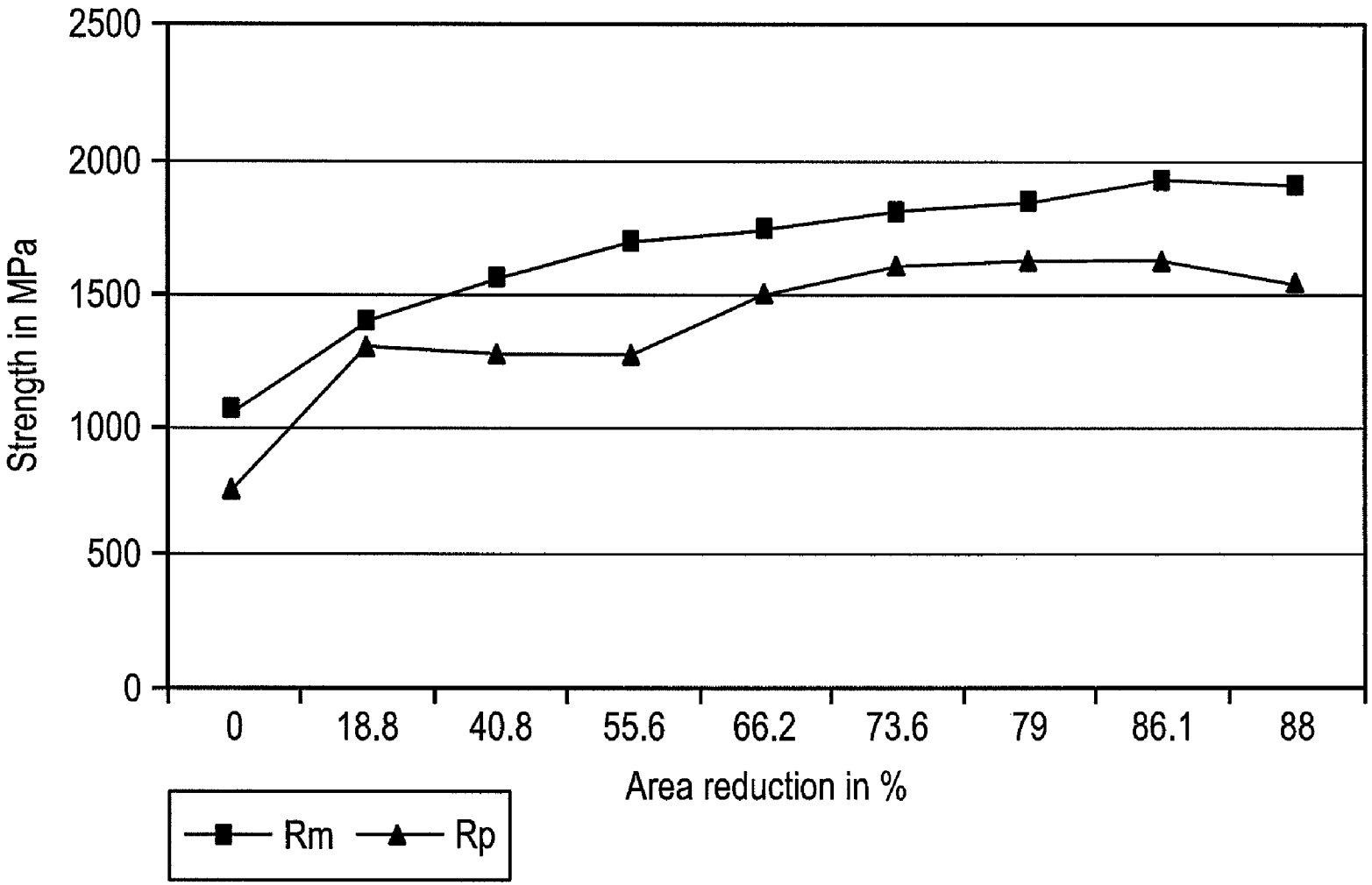
FIG. 5 shows data related to impact strength and yield point for the alloy according to the invention.

The test procedure is the same as for point corrosion testing according to ASTM G48C except for the used solution that is more aggressive than 6% $FeCl_3$, the so-called "green death"-solution. Also general corrosion testing in 2% HCl (2 tests per charge) has been carried out for ranking before dew point testing. The results from all tests appear from Table 6, FIG. 2 and FIG. 3. All the tested charges perform better than SAF 2507 in the green death solution. All the charges lie in the defined interval of 0.9-1.15, preferably 0.9-1.05 as regards the ratio PRE austenite/PRE ferrite at the same time as PRE for both austenite and ferrite exceeds 44 and for most charges also essentially exceeds 44. Some of the charges are even extending to the limit value totally PRE50. It is very interesting to observe that charge 605251 alloyed with 1.5% cobalt performs almost equally as good as charge 605250 alloyed with 0.6% cobalt in the "green death" solution in spite of the lower chromium content in charge 605251. This is of special surprise and interest since charge 605251 has a PRE-value of approximately 48 which is higher than for a commercial superduplex alloy at the same time as T-max sigma value under 1010° C. indicates good structure stability based on the values in Table 2 in example 1.

TABLE 6

| Charge | α content | PREW Total | PRE α | PRE γ | PREγ/ PREα | CPT ° C. the Green Death |
|---|---|---|---|---|---|---|
| 605258 | 48.2 | 50.3 | 48.1 | 49.1 | 1.021 | 65/70 |
| 605249 | 59.2 | 48.9 | 48.3 | 46.6 | 0.967 | 75/80 |
| 605259 | 49.2 | 50.2 | 48.8 | 48.4 | 0.991 | 75/75 |
| 605260 | 53.4 | 48.5 | 46.1 | 47.0 | 1.019 | 75/80 |
| 605250 | 53.6 | 49.2 | 48.1 | 46.8 | 0.974 | 95/80 |
| 605251 | 54.2 | 48.2 | 48.1 | 46.9 | 0.976 | 90/80 |
| 605261 | 50.8 | 48.6 | 45.2 | 46.3 | 1.024 | 80/70 |
| 605252 | 56.6 | 48.2 | 48.2 | 45.6 | 0.946 | 80/75 |
| 605254 | 53.2 | 48.8 | 48.5 | 46.2 | 0.953 | 90/75 |
| 605255 | 57.4 | 46.9 | 46.9 | 44.1 | 0.940 | 90/80 |
| 605262 | 57.2 | 47.9 | 48.3 | 45.0 | 0.931 | 70/85 |
| 605263 | 53.6 | 49.7 | 49.8 | 47.8 | 0.959 | 80/75 |

TABLE 6-continued

| Charge | α content | PREW Total | PRE α | PRE γ | PREγ/ PREα | CPT ° C. the Green Death |
|---|---|---|---|---|---|---|
| 605253 | 52.6 | 48.4 | 48.2 | 45.4 | 0.942 | 85/75 |
| 605266 | 62.6 | 49.4 | 48.3 | 47.6 | 0.986 | 70/65 |
| 605269 | 52.8 | 50.5 | 49.6 | 46.9 | 0.945 | 80/90 |
| 605268 | 52.0 | 49.9 | 48.7 | 47.0 | 0.965 | 85/75 |
| 605270 | 57.0 | 49.2 | 48.5 | 45.7 | 0.944 | 80/85 |
| 605267 | 59.8 | 49.3 | 47.6 | 45.4 | 0.953 | 60/65 |

TABLE 7

| Charge | CPT Average | CCT Average | RPO,12 RT | Rm RT | A RT | Z RT |
|---|---|---|---|---|---|---|
| 605258 | 84 | 68 | 725 | 929 | 40 | 73 |
| 605249 | 74 | 78 | 706 | 922 | 38 | 74 |
| 605259 | 90 | 85 | 722 | 928 | 39 | 73 |
| 605260 | 93 | 70 | 709 | 917 | 40 | 73 |
| 605250 | 89 | 83 | 698 | 923 | 38 | 75 |
| 605251 | 95 | 65 | 700 | 909 | 37 | 74 |
| 605261 | 93 | 78 | 718 | 918 | 40 | 73 |
| 605252 | 87 | 70 | 704 | 909 | 38 | 74 |
| 605254 | 93 | 80 | 695 | 909 | 39 | 73 |
| 605255 | 84 | 65 | 698 | 896 | 37 | 74 |
| 605262 | 80 | 83 | 721 | 919 | 36 | 75 |
| 605263 | 83 | 75 | 731 | 924 | 37 | 73 |
| 605253 | 96 | 75 | 707 | 908 | 38 | 73 |
| 605266 | 63 | 78 | 742 | 916 | 34 | 71 |
| 605269 | 95 | 90 | 732 | 932 | 39 | 73 |
| 605268 | 75 | 85 | 708 | 926 | 38 | 73 |
| 605270 | 95 | 80 | 711 | 916 | 38 | 74 |
| 605267 | 58 | 73 | 759 | 943 | 34 | 71 |

In order to investigate more in detail the structure stability the test pieces were annealed for 20 minutes at 1080° C., 1100° C., and 1150° C. after which they were quenched in water.

The temperature at which the amount of intermetallic phase became negligible was determined by means of investigations in light optical microscope. A comparison of the structure of the charges after annealing at 1080° C. followed by water quenching indicates which charges that are more likely to contain undesired sigma phase. The results appear from Table 8. Structure control shows that the charges 605249, 605251, 605252, 605253, 605254, 605255, 605259, 605260, 605266 and 605267 are free from undesired sigmaphase. Further, charge 605249 alloyed with 1.5% cobalt is free from sigmaphase whereas charge 605250 alloyed with 0.6% cobalt contains some sigmaphase. Both charges are alloyed with high chromium content close to 29 wt % and molybdenum content of close to 4.25 wt %. If we compare the analysis for charges 605249, 605250, 605251 and 605252 with regard to sigma phase content it is very clear that the interval of the analysis for the optimal material with regard to in this case structure stability is very tight. Further, it appears that charge 605268 contains only minor sigmaphase compared with the charge 605263 which contains large amount of sigmaphase. The essential difference between these two charges is the added copper amount into charge 605268. In charge 605266 and 605267 the sigmaphase is free from high chromium content whereby the latter charge is alloyed with copper. Further the charges 605262 and 605263 containing 1.0 wt % tungsten appear with a structure having high amount of sigmaphase whereas it is of interest to observe that charge 605269 also containing 1.0 wt % tungsten but with higher nitrogen content that 605262 and 605263 appear with a substantially smaller amount of sigmaphase. Hence, it is required carefully balanced amounts between the various alloy elements at these high amounts of elements as regards for example chromium and molybdenum for achieving good structure properties.

TABLE 8

| Charge | Sigma phase | Cr | Mo | W | Co | Cu | N | Ru |
|---|---|---|---|---|---|---|---|---|
| 605249 | 1 | 28.8 | 4.23 | | 1.5 | | 0.38 | |
| 605250 | 2 | 28.8 | 4.24 | | 0.6 | | 0.40 | |
| 605251 | 1 | 28.1 | 4.24 | | 1.5 | | 0.38 | |
| 605252 | 1 | 28.4 | 4.23 | | 0.5 | | 0.37 | |
| 605253 | 1 | 28.8 | 4.16 | | 1.5 | | 0.37 | |
| 605254 | 1 | 26.9 | 4.80 | | 1.0 | | 0.38 | |
| 605255 | 1 | 28.6 | 4.04 | | 3.0 | | 0.31 | |
| 605258 | 2 | 29.0 | 4.23 | | 1.5 | | 0.46 | |
| 605259 | 1 | 29.0 | 4.23 | | 0.6 | | 0.45 | |
| 605260 | 1 | 27.5 | 4.22 | | 1.5 | | 0.44 | |
| 605261 | 2 | 27.8 | 4.22 | | 0.6 | | 0.43 | |
| 605262 | 4 | 27.6 | 3.93 | 1.0 | 1.0 | | 0.36 | |
| 605263 | 5 | 28.7 | 3.96 | 1.0 | 1.0 | | 0.40 | |
| 605266 | 1 | 30.0 | 4.02 | | | | 0.38 | |
| 605267 | 1 | 29.3 | 4.23 | | | 1.5 | 0.38 | |
| 605268 | 2 | 28.2 | 3.98 | 1.0 | 1.0 | 1.0 | 0.43 | |
| 605269 | 3 | 28.5 | 3.97 | 1.0 | 1.0 | | 0.45 | |
| 605270 | 3 | 28.8 | 4.19 | | 1.5 | | 0.41 | 0.1 |

In Table 8, numeral 1 for sigma phase is equivalent to free from undesired sigma phase.

Example 3

The stress picture for a wire in a wireline application is mainly composed of three components as appears from Table 9: the wire's dead load pursuant to equation (1), the impacted load according to equation (2) and the stress induced by the various support wheels of the feeding equipment according to equation (3) and the total tension expressed as the sure of partial tensions according to equation (4). As appears from the expressions for the various tensions; described below, a higher tension/ultimate strength enables use of smaller feeding wheels as well as larger added load per area unit.

TABLE 9

| | Expression for induced tension |
|---|---|
| (1) Wire dead load | $\sigma_1 = \rho g l/2$; ρ = material density<br>g = acceleration of gravity, l = the free length of the wire in the drill hole |
| (2) Added load | $\sigma_2 = F/A$; F = added load, A = wire |
| (3) Support wheel | $\sigma_3 = dE/R$; d = wirediameter, E = E-modulus<br>R = support wheel radius |
| (4) Total | $\sigma = \sigma_1 + \sigma_2 + \sigma_3$ |

A long wire can in the intended application as slickline amount to 30,000 feet length and will appear with a remarkable dead load which will load upon the wire. Thus dead load is usually carried by a wheel of varying curvature which will add to the load impact upon the wire. The smaller radius of curvature used for the wheel the higher will the bending load be that is implied upon the wire. At the same time, a smaller wire diameter will sustain larger amounts of winding. The alloy of the invention appears surprisingly to have a very high corrosions resistance in an environment relevant for the application of wirelines.

A higher strength of the alloy can be achieved for a given reduction according to the invention as compared with conventional alloys. Hence, a produced amount of goods with dimension 2.08 mm (0.082") is obtained with the following data:

Charge: 456904

Final dimension: 2.08 mm

E-modulus: 195266 N/mm2

Rm: 1858 N/mm2 Breaking load: 6344 N=1426 lbf

No presence of sigmaphase

Ductility: Acceptable

Table 10 shows strength and break load for the alloy of the invention as compared with hitherto used alloys:

TABLE 10

| | | Tensile Str | | Break load(lbf)per size(inch) | | | | | | |
|---|---|---|---|---|---|---|---|---|---|---|
| Alloy | PRE | ksi | MPa | .072" | .082" | .092" | .108" | .125" | .14" | .15" |
| GD22 | | 225 | 1550 | 916 | | 1495 | 2061 | 2761 | | |
| GD31Mo | | | | | | | | 2822 | | |
| High Strength Bridon SUPA 75 | | | | | 1240 | 1550 | 2030 | 2560 | | |
| Sandvik SAF 2205 | 35 | 250 | 1700 | 1010 | 1310 | 1650 | 2275 | 3045 | 3795 | 4356 |
| Sandvik SAF 2507 | 43 | 255 | 1750 | 1035 | 1345 | 1690 | 2330 | 3120 | | |
| Alloy according to the invention | 46 | | 1858 | | 1426 | | | | | |

These properties will make an alloy of the invention very suitable for use within O & G-industry such as in applications for wirelines, slicklines or control cables.

SUMMARY

The present invention has a unique combination of

High corrosion resistance

High strength both in hot worked status as well as after cold working

Good ductility

Good structure stability, minimal risk of precipitation of intermetallic phases provided that controlled temperature conditions are maintained Good hot workability

The invention claimed is:

1. Wire for slickline, wireline or well-logging cable consisting of a ferrite-austenite duplex stainless steel alloy containing in percent by weight:

| | |
|---|---|
| C | larger than 0 to max 0.03 |
| Si | max 0.3 |
| Mn | 0-3.0 |
| Cr | 24.0-30.0 |
| Ni | 4.9-10.0 |
| Mo | 3.0-5.0 |
| N | 0.40-0.45 |
| B | 0-0.0030 |
| S | max 0.010 |
| Co | 0.5-3.5 |
| W | 0-3.0 |
| Cu | 0-2.0 |
| Ru | 0-0.3 |
| Al | 0-0.03 |
| Ca | 0-0.010 |

remainder Fe and normally occurring impurities and additions, wherein the ferrite content amounts to 40-65 percent by volume, said steel having high strength both in hot worked condition as well as after cold working, good ductility and good structure stability, wherein a ratio of PRE in an austenite phase to PRE in a ferrite phase is 0.9 to 1.15 with at least one of PRE in the austenite phase and PRE in the ferrite phase is greater than 48, and wherein the alloy is free from sigma phase.

2. Wire according to claim 1, wherein the chromium content is 26.5-29.0 wt %.

3. Wire according to claim 1, wherein the nickel content is 5.0-8.0 wt %.

4. Wire according to claim 1, wherein the molybdenum content is 3.6-4.7 wt %.

5. Wire according to claim 2, wherein the molybdenum content is 3.6-4.7 wt %.

6. Wire according to claim 3, wherein the molybdenum content is 3.6-4.7 wt %.

7. Wire according to claim 1, wherein the ruthenium content is greater than zero and up to 0.1 wt %.

8. Wire according to claim 2, wherein the ruthenium content is greater than zero and up to 0.1 wt %.

9. Wire according to claim 1, wherein the copper content is 1.0-1.5 wt %.

10. Wireline comprising a wire according to claim 1.

11. Slickline comprising a wire according to claim 1.

12. Well-logging cable comprising a wire according to claim 1.

13. Wire according to claim 1, wherein the B content is greater than 0 to 0.0030 wt %.

14. Wire according to claim 1, wherein the Co content is 1.0 to 3.5 wt %.

15. Wire according to claim 1, wherein the Mn content is from about 2.7 wt % to 3 wt %.

16. Wire according to claim 1, wherein the Ni content is from about 9.8 wt % to 10 wt %.

17. Wire according to claim 1, wherein the ferrite content amounts to 45-65 percent by volume.

18. Wire according to claim 1, wherein at least one of PRE in the austenite phase and PRE in the ferrite phase is greater than 48 and the other phase has a PRE of at least 45.

* * * * *